United States Patent [19]

Rothfuss et al.

[11] 4,030,655

[45] June 21, 1977

[54] IMPROVED FASTENER APPLYING DEVICE

[75] Inventors: Robert G. Rothfuss, Bellevue, Ky.; Carl T. Becht, Cincinnati, Ohio

[73] Assignee: Senco Products, Inc., Cincinnati, Ohio

[22] Filed: Jan. 8, 1976

[21] Appl. No.: 647,430

Related U.S. Application Data

[63] Continuation of Ser. No. 446,632, Feb. 28, 1974, abandoned, which is a continuation of Ser. No. 210,812, Dec. 22, 1971, abandoned.

[52] U.S. Cl. ..... 227/130; 91/402; 91/461

[51] Int. Cl.[2] ..... B25C 1/04; F15B 13/042

[58] Field of Search ..... 91/398, 399, 403, 404, 91/420, 461, 304, 402; 227/130

[56] References Cited

UNITED STATES PATENTS

| | | | |
|---|---|---|---|
| 3,055,344 | 9/1962 | Fisher | 227/130 |
| 3,190,187 | 6/1965 | Doyle | 91/403 |
| 3,278,104 | 10/1966 | Becht et al. | 227/130 |
| 3,320,860 | 5/1967 | Bade | 227/130 X |
| 3,434,643 | 3/1967 | Wandel | 227/130 |
| 3,601,007 | 8/1971 | Korth | 91/461 X |
| 3,657,968 | 4/1972 | Lange | 91/399 X |
| 3,715,069 | 2/1973 | O'Connor | 227/130 |
| R26,262 | 9/1967 | Juiles | 227/130 |

FOREIGN PATENTS OR APPLICATIONS

| | | | |
|---|---|---|---|
| 1,936,356 | 1/1970 | Germany | 227/130 |

*Primary Examiner*—Irwin C. Cohen
*Attorney, Agent, or Firm*—Melville, Strasser, Foster & Hoffman

[57] ABSTRACT

A pneumatic fastener driving tool in which a piston-driver assembly is moved in opposed working and return strokes within a cylinder. Vent passage means of a predetermined area are provided adjacent the lower end of the cylinder to permit greatly increased velocity on the working stroke. Valve means may be provided for the vent passage to enable the use of air under pressure to drive the piston in a return stroke.

The cylinder may be defined by an axially movable sleeve, which cooperates with sealing means to provide one or more valving functions.

7 Claims, 8 Drawing Figures

INVENTOR/S
ROBERT G. ROTHFUSS
CARL T. BECHT

BY Melville, Strasser, Foster and Hoffman
ATTORNEYS

INVENTOR/S

ROBERT G. ROTHFUSS

CARL T. BECHT

BY Melville, Strasser, Foster and Hoffman
ATTORNEYS

INVENTOR/S

ROBERT G. ROTHFUSS
CARL T. BECHT

BY Melville, Strasser, Foster and Hoffman
ATTORNEYS

INVENTOR/S
ROBERT G. ROTHFUSS
CARL T. BECHT

BY Melville, Strasser, Foster and Hoffman
ATTORNEYS

INVENTOR/S
ROBERT G. ROTHFUSS
CARL T. BECHT
BY Melville, Strasser, Foster and Hoffman
ATTORNEYS

IMPROVED FASTENER APPLYING DEVICE

BACKGROUND OF THE INVENTION

This is a continuation of application Ser. No. 446,632, filed Feb. 28, 1974 and now abandoned, which was a continuation of application Ser. No. 210,812 filed Dec. 22, 1971 and now abandoned, and relates to pneumatic fastener applying devices, and particularly to an improved design in construction for greatly increasing the efficiency of such devices.

The background of this invention can best be understood by referring to U.S. Pat. No. Re. 26,262 in the name of A. G. Juilfs, and U.S. Pat. No. 3,170,487 in the name of A. G. Juilfs et al. According to each of these patents, the pneumatic fastener applying device includes a tool body or housing having a working cylinder disposed therein. A piston and attached fastener driver is disposed within the cylinder for movement in a working cycle including opposed working and return strokes.

Each of these patents also contemplates the provision of a main valve which, in the open position admits air under pressure into the working cylinder to drive the piston in its working stroke. In the closed position, this main valve structure is effective to vent the upper end of the working cylinder to atmosphere to permit the return stroke of the piston.

According to these two references, the main valve is pneumatically actuated. That is, it is moved to the open position in response to manual actuation of a remote valve.

Both of these patents teach what might be called a plenum chamber return system. That is, the air under pressure is supplied to a return reservoir which, by the valve structure taught in these patents, is effective to utilize the stored air under pressure to return the piston to its starting position after the main valve has closed.

Fastener applying devices of the type generally described have now been developed to the point where relatively large fasteners can be successfully driven. For example, staples having a leg length of 3 inches, or 10d common nails can be readily driven.

In order to provide sufficient driving force, it has generally been considered necessary to either increase the air pressure with which the tool is used (which is a most impractical alternative) or to increase the bore and stroke of the working cylinder. This of course results in much larger and heavier tools which are extremely difficult for the operator to handle.

Extensive testing with pneumatic tools of the prior art has proved that no existing tool is more than 50% efficient. That is, no tool has been developed in which the driving energy is more than 50% of the theoretical energy for the actual bore and stroke of a given tool.

It is an object of this invention to provide a completely new design which will enable pneumatic tools to reach an efficiency level in excess of 80%.

It is a more specific object of this invention to provide a vent structure for the lower end of the working cylinder of a fastener driving tool. This includes a vent passage and valve means effective to maintain the vent passage open during the working stroke of the tool and to close the vent passage so that a plenum return system can be used.

SUMMARY OF THE INVENTION

In its broadest aspect, this invention contemplates a pneumatic fastener applying device of greatly increased efficiency. This increased efficiency is obtained by a variety of factors operating in cooperation.

First and foremost is the discovery that in a fastener driving device utilizing a piston and working cylinder, a vent can be provided for the lower portion of the cylinder which is open to atmosphere during substantially the entire working stroke of the tool. As will be explained in more detail hereinafter, the vent valve structure will preferably be arranged to close at the termination of the working stroke in order to utilize a plenum type air return system to return the piston to its original position.

Additionally, the cross sectional area of the vent passage should bear a predetermined ratio to the cross sectional area of the cylinder in order to achieve a given efficiency of operation.

Other important aspects of the invention would include the provision of an improved remote valve structure which makes opening and closing of the main valve of the tool independent of the speed or manner in which the operator handles the trigger of the device.

A further aspect of the invention is the development of a unique, effective, and extremely long wearing sealing arrangement associated with the vent valve structure.

DESCRIPTION OF THE PREFERRED EMBODIMENT

General Arrangement

Figure 1:
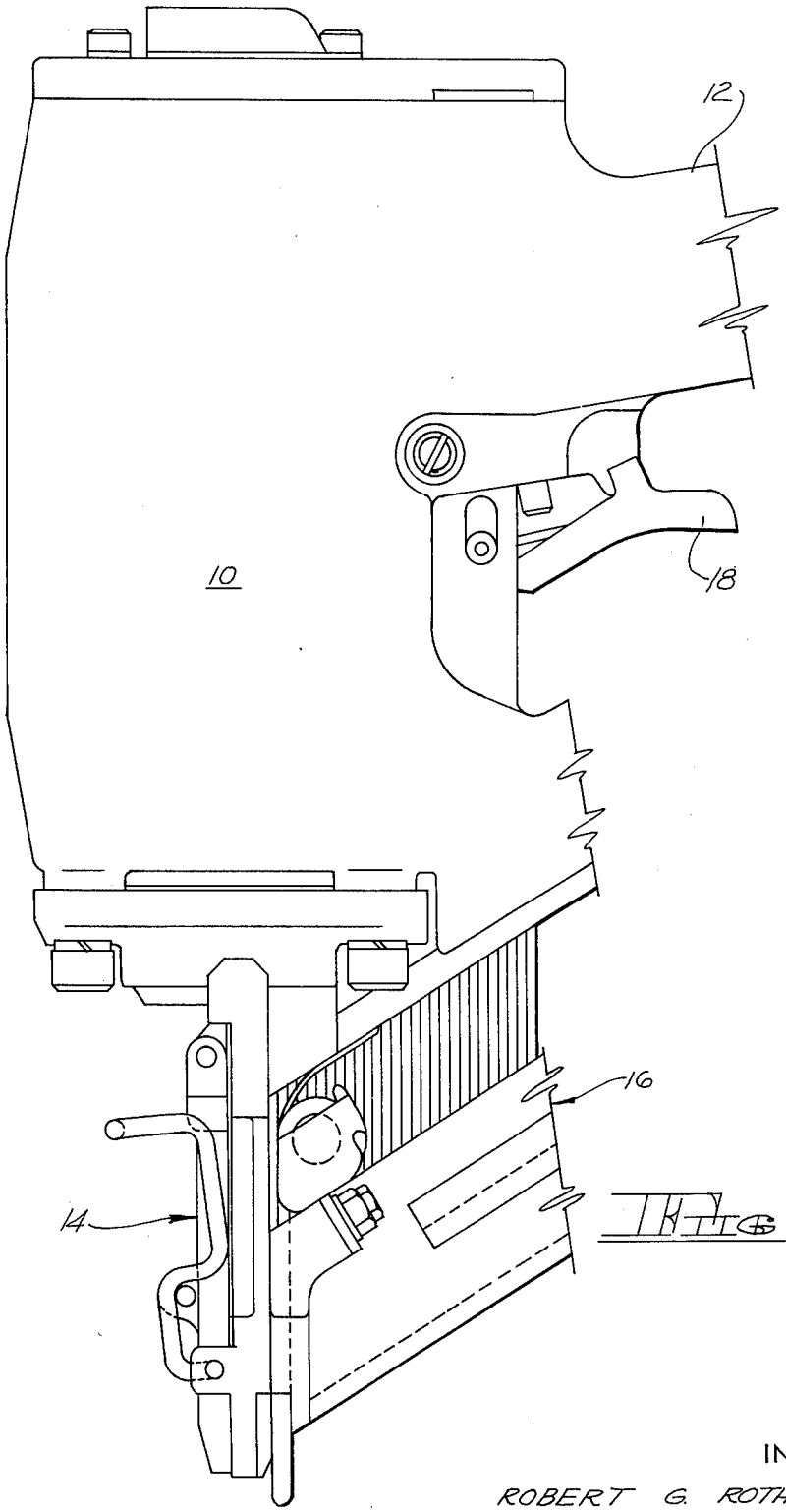
FIG. 1 is a side elevation of a portion of a fastener applying device according to this invention.

Referring first to FIG. 1, the pneumatic fastener driving tool of this invention includes a tool body having a head portion indicated at 10, a rearwardly extending handle portion indicated at 12, a nose piece or guide body indicated generally at 14, a magazine structure indicated generally at 16, and a manually actuated trigger 18. As is well known in the art, the nose piece 14 has an internal passage or drive track into which fasteners are successively delivered by the magazine structure 16. A fastener located in the drive track is driven downwardly into a work piece by means of a piston and associated fastener driver which is reciprocated in a cylinder disposed within the head portion 10.

Figure 2:
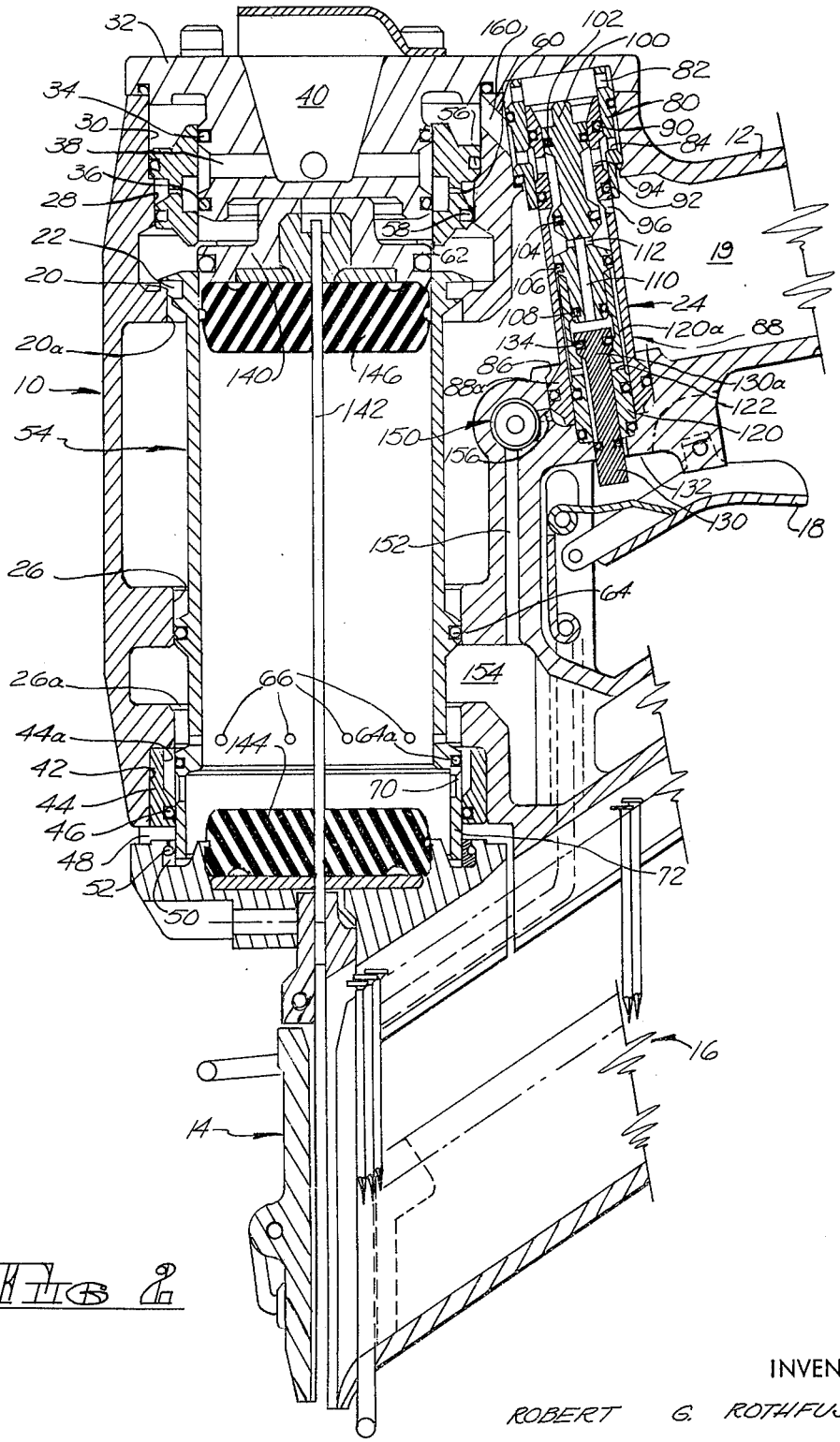
FIG. 2 is a longitudinal cross sectional view through the tool shown in FIG. 1.
Figure 3:
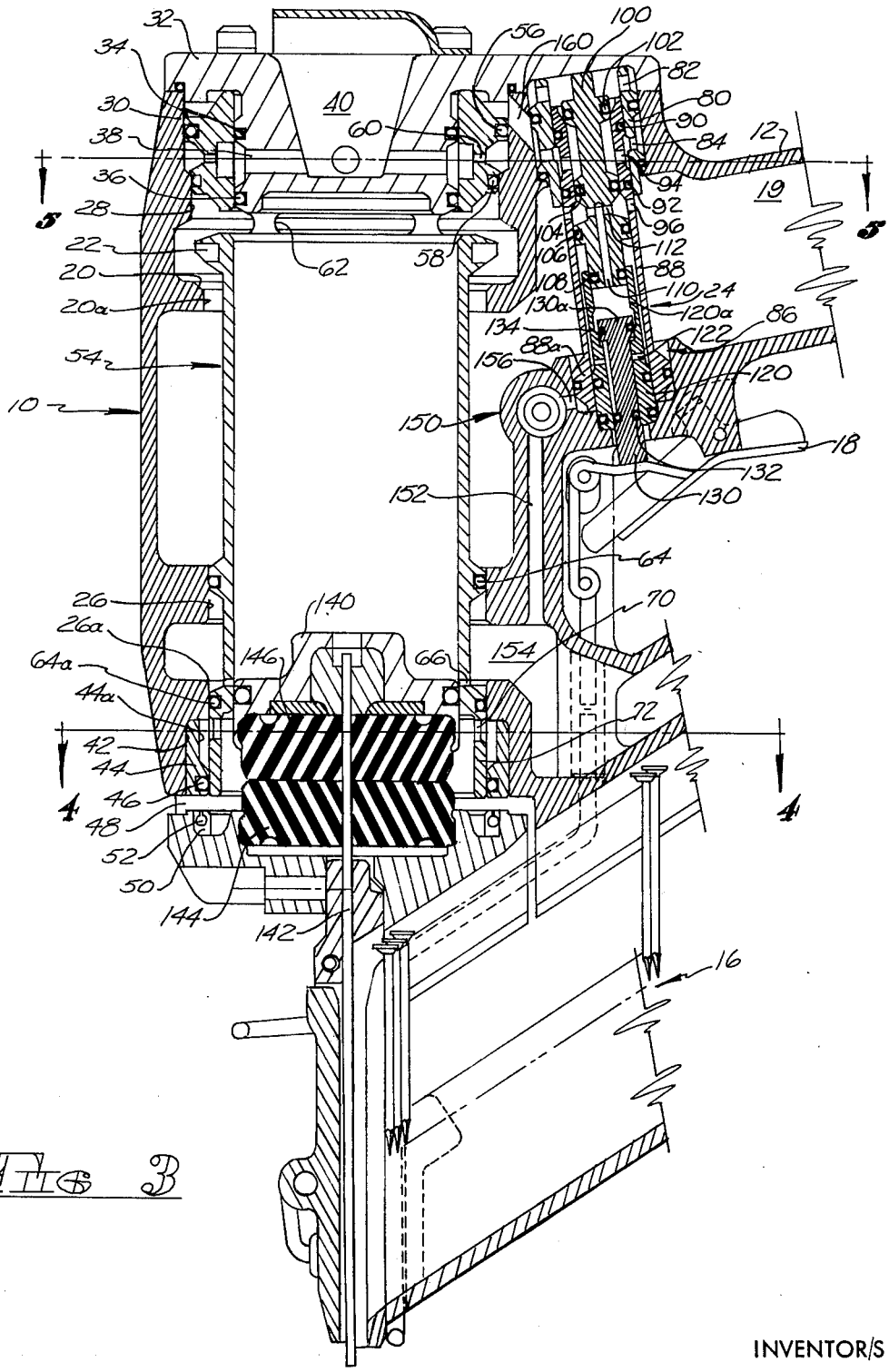
FIG. 3 is a cross sectional view similar to FIG. 2 showing the components at a different stage in operation.
Figure 4:
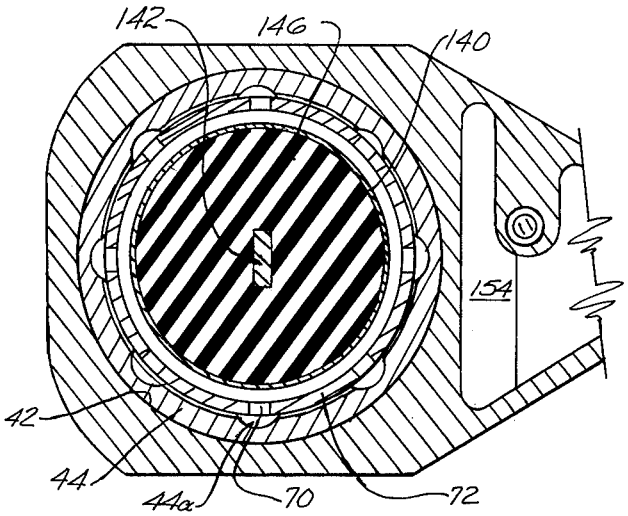
FIG. 4 is a horizontal cross sectional view along the line 4—4 of FIG. 3.

Turning now to FIGS. 2 and 3, it will be seen that the handle portion 12 of the tool body is hollow and defines a reservoir 19. It will of course be understood that the handle portion and reservoir 19 will be connected in a conventional manner to a suitable source of compressed air. Flow of compressed air into the working cylinder is controlled by the coaction of the valve seat 20 formed on the interior of the head portion 10 and the sealing ring 22. It should be apparent that the main valve structure is shown in the closed position in FIG. 2 and in the open position in FIG. 3.

As will be explained in more detail hereinafter, the main valve just described is pneumatically actuated. Generally considered, the opening and closing of the firing valve is controlled by the trigger actuated remote valve indicated generally at 24.

Main Sleeve and Valving Structure

Proceeding now with a more detailed description of the components, the head portion 10 of the housing is machined so as to provide the circular sealing surfaces 26 and 26*a* which are of the same diameter. The bore 20*a* below the main valve seat 20 described earlier is of slightly larger diameter than the areas 26 and 26*a*. Near its upper end, the housing is provided with the sealing surfaces 28 and 30 which are each progressively larger in diameter.

The top of the head portion 10 is closed by means of the cap 32. It will be observed that the cap 32 has a downwardly extending center portion which includes the sealing O rings 34 and 36, and the passages 38 therebetween. The passages 38 open into a tapered, central bore 40 which is open to atmosphere.

Near its lower end, the head portion 10 is provided with the counterbore 42 which receives the sealing insert 44 which has a plurality of semi-cylindrical grooves 44*a* in the upper portion of its inner surface, and the O ring seal 46 carried in a groove on the lower portion of its inner surface. Immediately below the bottom edge of the insert 44 are a plurality of vent passages 48.

At the very bottom of the cavity in the head portion 10 is the annular seal for the vent valve which includes a ring of Teflon or the like 50 which is encircled by the O ring 52. The material for the ring 50 is preferably a plastic material having a very low coefficient of friction. In the case of Teflon, the O ring 52 serves to maintain the Teflon ring in the proper shape.

Slidably received within the head portion 10 of the tool is the machined sleeve indicated generally at 54. The sleeve in this embodiment performs four different valving functions, in addition to acting as a cylinder within which the working piston reciprocates. First of all, this sleeve carries the sealing ring 22, and hence the sleeve also constitutes a part of the main or firing valve of the tool. Secondly, the lower end portion of the sleeve cooperates with the ring 50 to form a vent valve seal. Thus, the sleeve also functions as a part of the vent valve for the bottom end of the working cylinder. Thirdly, the upper portion of the sleeve cooperates with the O ring 36 to form an exhaust valve for the upper portion of the cylinder. Finally, the sleeve is effective to open and close communication between the return reservoir and the underside of the piston at the bottom of its stroke.

Considering first the outside formation of the sleeve 54, it will be observed that adjacent its top end, it is provided with the annular lands which carry the O rings 56 and 58 respectively. Clearly, the outside diameter of the O ring 56 is greater than that of the O ring 58. The O rings 56 and 58 respectively are in sealing engagement with the surfaces 28 and 30 inside the head portion 10 of the tool.

Between the O rings 56 and 58 are a plurality of radial ports 60. These ports provide a constant vent for the portion of the exterior of the sleeve between the O rings 56 and 58. Below the O ring 58 and above the main valve sealing ring 22, the sleeve is provided with the relatively large, radial slots 62. It is through these slots 62 that compressed air enters the working cylinder.

At its lower end, the sleeve includes the sealing O rings 64 and 64*a* which are in sealing engagement, respectively, with the surfaces 26 and 26*a*. Again, the outside diameter of these O rings is identical. Between the O rings 64 and 64*a* are a plurality of radial ports 66 through the sleeve. These ports 66 in cooperation with the main piston and the movable sleeve 54 form a one-way valve from the interior of the sleeve 54.

Below the O ring 64*a* are the radial ports 70 and the cylindrical surface 72 which is nominally of the same diameter as the O rings 64 and 64*a*.

Remote Valve

The remote valve previously indicated generally at 24 will be described next. It includes the reducing insert 80 which is received within a counterbore in the housing and held fixedly in position by the car 32. The insert 80 is provided with a plurality of radial ports 82 adjacent its upper end and a plurality of radial ports 84 adjacent its center. Slidable within the insert 80 and within a bore 86 in the tool body is the sleeve 88. It will be observed that the lower portion 88*a* of the sleeve is of larger diameter than the remainder of the sleeve. The upper portion of the sleeve 88 is provided with the O rings 90 and 92 and with the radial ports 94 between the O rings. A short distance below the O ring 92 are the radial ports 96.

Slidably disposed in the upper portion of the sleeve 88 is the oscillating stem 100. This stem includes a series of O rings identified at 102, 104, 106, and 108. The oscillating stem is also provided with the central bore 110 and the cross bore 112 disposed between the O rings 104 and 106.

Disposed within the lower portion of the sleeve 88 is a second sleeve 120. It will be observed that the outside diameter of the upper portion 120*a* of the sleeve is somewhat smaller than the inside diameter of the sleeve 88 so as to define therebetween an annular passage. The sleeve 120 is also provided with the passages 122 extending between the bore in the sleeve 120 and this annular passage.

Finally, the actuating stem 130 is slidably disposed within the sleeve 120. It will be observed that the upper portion 130*a* is of substantially larger diameter than the balance of the stem.

Piston, Driver and Stop Assembly

The piston 140 and fastener driver 142 are largely conventional in design. They are shown in the full up or normal rest position in FIG. 2 and in the down position at the conclusion of a working stroke in FIG. 3.

Because of the greatly increased efficiency of the tool of this invention, conventional fastener stops in the form of a pad of resilient material or the like are subject to extremely rapid wear. Accordingly, according to this invention, a resilient pad 144 is provided at the bottom of the cylinder, and a second pad 146 is provided adjacent the underside of the piston. It is known that the effectiveness of a resilient piston stop depends in part upon the ratio between the height of the piston stop and its cross sectional surface area. By splitting the piston stop into two components, this ratio is effectively doubled, thereby greatly increasing the life of the piston and piston stop assembly.

Mode Selector Valve

The mode selector valve is indicated generally in FIGS. 2 and 3 at 150. This valve communicates via the passage 152 with the air return reservoir 154, and via the passage 156 with the space below the enlarged end 88*a* of the sleeve 88.

Figure 6:
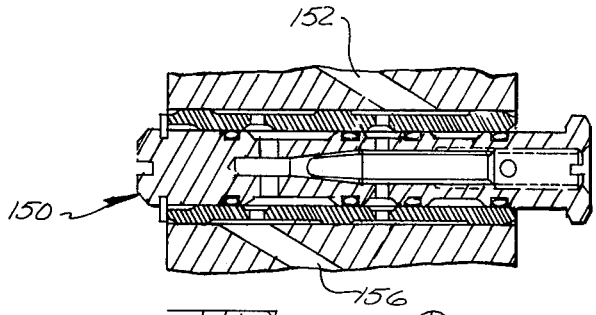
FIG. 6 is an enlarged, cross sectional view through the mode selector valve.
Figure 5:
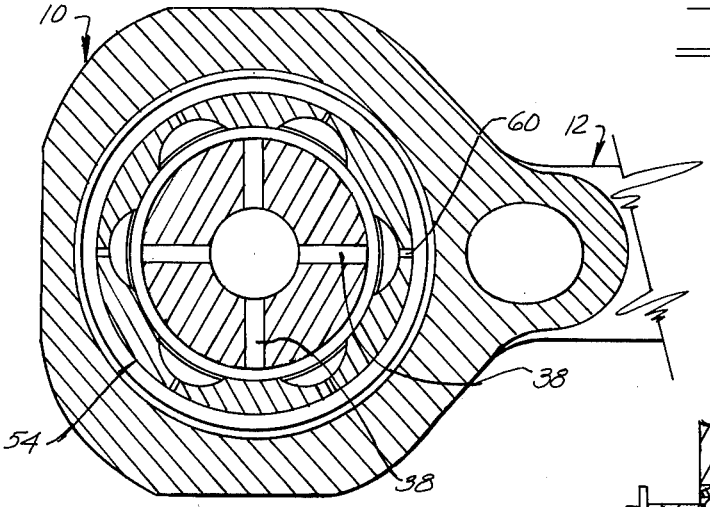
FIG. 5 is a horizontal cross sectional view along the line 5—5 of FIG. 3.
Figure 7:
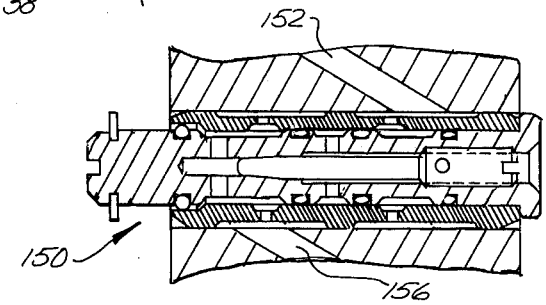
FIG. 7 is a cross sectional view similar to FIG. 6 showing the mode selector valve in a different position.

The enlarged cross sectional views of FIGS. 6 and 7 depict the mode selector valve 150 in two different operating positions. It is shown in the "autofire" position in FIG. 6 and in the "single fire" position in FIG. 7.

Reference is made to U.S. Pat. No. 3,278,104 in the name of C. T. Becht et al which includes a full disclosure of a mode selector valve. (See, for example, FIG. 7 and the specification).

The mode selector valve does not per se form a part of this invention, and hence will not be described herein in detail. For present purposes, it includes an element which is shiftable between two positions. In the position shown in FIG. 7, the passage 156 is vented to atmosphere, and the passage 152 is sealed. In the position shown in FIG. 6, the passages 152 and 156 are in communication.

Brief Description of Operation

FIG. 2 shows the position of the various components of the tool when the device is connected to a supply of air under pressure. In this condition, the piston 140 is in the full up position. Air in the reservoir 19 cannot enter the working cylinder because of the sealing engagement between the valve seat 20 and the sealing ring 22.

Air from the reservoir 19 also passes through the ports 96 of the sleeve 88, out through the ports 94, then through the ports 84 in the insert 80, and into the passage 160 which communicates with the space above the largest portion 56 of the main sleeve 54.

In this condition, air in the reservoir 19 will be acting upwardly on the underside of sealing ring 22, and downwardly on the portion of the sleeve containing O ring 64. It will be observed that the diameter of the bore 20*a* is slightly greater than the diameter of the bore 26, thus producing a resultant upward force.

The topside of the sealing ring 22 and the space below the O ring 58 is vented to atmosphere via the slot 62, past the O ring 36, through the ports 38 and 40.

Finally, as will be recalled, air from the reservoir 19 has passed through the remote valve structure 24, through the passage 160 and into the space above the largest diameter portion of the sleeve. It will be apparent that the final resultant force is downward, thus holding the main valve closed by maintaining the sealing engagement between the ring 22 and seat 20, and holding the vent valve port at the lower end of the cylinder closed by maintaining the cylindrical portion 72 in sealing engagement with the inner surface of the ring 50.

A working cycle is initiated by upward movement of the actuator 130. This of course may be accomplished in a variety of ways which are well known in the art. For present purposes, it is enough to note that the actuator 130 is moved from the position shown in FIG. 2 to the position shown in FIG. 3. This movement brings the lower O ring 132 into sealing engagement with the bore of the lower sleeve 120, and moves the upper O ring 134 into a relieved area in the bore of the member 120. Thus, air under pressure from the reservoir 19 which has entered the sleeve 88 through the ports 96, and which also passes through the cross port 112 and the central passage 110, may now pass around the O ring 134, through the passage 122 and into the narrow, annular space between the sleeves 120 and 88. In other words, compressed air is now acting upon the outer annular edge of the oscillating stem at its point of largest diameter, namely, where the O ring 106 is located. In addition, of course, air under pressure is acting on the entire bottom surface of the oscillating stem 100. The resultant force is upwardly, moving the stem to the position shown in FIG. 3.

At this point, the O ring 104 on the stem moves into sealing engagement with the internal wall of the sleeve 88, thereby preventing further passage of air under pressure between the ports 92 and 94. Shortly after this sealing engagement is established, the O ring 102 moves out of sealing engagement with the wall of the sleeve 88. This permits air under pressure from the space above the top of the main sleeve 54 to exhaust to atmosphere via the passage 160, through the ports 84, the ports 94, past the O ring 102 and through a slot formed between the undersurface of the cap 32 and the top surface of the tool body.

It will be recalled that the diameter of the bore 20*a* is somewhat greater than the diameter of the bore 26, creating a resultant upward force. Once the pressure has been reduced in the space above the sleeve, this upward force begins to move the sleeve 54 upwardly. As soon as the sealing engagement between the seat 20 and the ring 22 is broken, air under pressure acts upon the full diameter of the sleeve within the bore 28, rapidly moving it to the full up position shown in FIG. 3.

This upward movement does four things. First of all, it opens the main valve so that air under pressure may flow through the slots 62 into the working cylinder to drive the piston 140 and driver 142 downwardly in a working stroke.

Secondly, it moves the cylindrical portion 72 of the sleeve out of sealing engagement with the ring 50, thereby opening the communication between the interior of the cylinder and the vent ports 48.

Thirdly, a portion of the inner surface of the sleeve moves into sealing engagement with O ring 36, thereby closing the exhaust passages 38 from the upper portion of the cylinder.

Finally, the O ring 64*a* moves into sealing engagement with the surface 26*a* to permit charging of the return reservoir 154.

It will be appreciated by the skilled worker in the art that as a piston is moved downwardly at high velocity in a cylinder, the compression of air beneath that piston will tend to retard its velocity. It has now been discovered that this is the primary factor which accounts for the low level of efficiency (on the order of 45%) of conventional, pneumatic fastener applying devices.

According to this invention, the vent passage at the bottom of the working cylinder should have a cross sectional area equal to approximately 14% of the cross sectional area of the cylinder. Under these conditions, it has been empirically determined that the velocity of the piston shows a very rapid increase during the first portion of the stroke. This velocity continually increases until a maximum velocity is reached, and this maximum velocity does not decrease during the remainder of the stroke. A vent passage area less than 14% of the cross sectional area of the cylinder will result in a decrease in velocity of the piston during the last portion of the stroke.

In connection with the driving of fasteners, it is well recognized in the art that it is the terminal portion of the stroke which is of critical importance in fully driving a fastener into a work piece. Thus, it is particularly important that a decrease in piston velocity be avoided.

When the piston 140 reaches substantially the bottom of its working stroke, it will uncover the ports 66 in the wall of the sleeve. Air under pressure in the working cylinder thus will pass through those ports, and fill the return reservoir 154 with air under pressure.

Assuming the mode selector valve 150 is set for "single fire" operation, air in the passage 152 cannot communicate with the passage 156. Thus, the tool will remain with the piston in the full down position so long as the actuator 130 is maintained in the upper position.

Upon release of the trigger or other control mechanism, permitting downward movement of the actuator 130 by virtue of compressed air acting on the top surface of the portion 130*a*, the O ring 132 will move out of sealing engagement with the bore in the lower sleeve 120. This will permit the air under pressure in the annular space between the portion 120*a* and the sleeve 88 to exhaust to atmosphere via the ports 122 and past the O ring 132. The resultant force acting on the oscillating stem 100 will thereupon move it downwardly to the position shown in FIG. 2, first bringing the O ring 102 into sealing engagement with the interior of the sleeve 88, and then moving the O ring 104 into the relieved space on the interior of the sleeve 88. This closes the vent passage and once again permits compressed air to flow from the reservoir 19 through the passage 160 and into the space above the main sleeve. The greater area of the bore 30 produces a downward resultant force moving the main sleeve back to the position in FIG. 2. This movement of the sleeve again performs four functions. First of all, it closes the main valve by bringing the resilient ring 22 into engagement with the seat 20.

Secondly, it closes the vent passage 48 at the base of the cylinder by moving the cylindrical portion 72 into sealing engagement with the ring 50.

Thirdly, it opens the exhaust passage for the upper portion of the cylinder by moving the O ring 36 out of sealing engagement with the interior of the sleeve. Thus, compressed air in the working cylinder above the piston may exhaust to atmosphere past the O ring 36, through the passages 38 and 40.

Finally, the O ring 64*a* moves out of engagement with the surface 26*a* permitting compressed air in the return reservoir 154 to act via the ports 70 in the sleeve on the underside of the piston 140, forcing it in a return stroke to the upper position.

A plenum type air return system of substantially the type just described is shown and claimed in U.S. Pat. No. Re. 26,262 in the name of A. G. Juilfs, issued on Sept. 5, 1967.

In the case where the mode selector valve 150 is set in the "autofire" position shown in FIG. 6, the first portion of the operating cycle will be as described above. However, when the piston is in the lowermost position and the return reservoir is filled with air under pressure, the valve 150 will permit communication between the passages 152 and 156, thereby bringing the compressed air underneath the enlarged lower end portion of the sleeve 88. This will be effective to move the sleeve 88 upwardly with respect to both the actuator 130 and the oscillating stem 100. This will have the effect of bringing, in particular, the oscillating stem 100 and the upper portion of the sleeve 88 into the same relative position shown in FIG. 2, even though the actuator 130 is maintained in the upper position shown in FIG. 3. As explained earlier, this will be effective to introduce compressed air from the reservoir 19 to the space above the main sleeve, bringing it once again to the closed position. This will move the main sleeve 54 to the closed position shown in FIG. 2 and effect the return stroke of the piston as described earlier.

Return of the piston will of course exhaust the compressed air in the reservoir 154 and passages 152 and 156. This will permit air in the reservoir 19 to automatically move the sleeve 88 downwardly to the position shown in FIG. 3, which as explained before will cause the sleeve 54 to move upwardly once again, thereby repeating the cycle of operation.

Thus, when the mode selector valve 150 is in the "autofire" position, the tool will continue to cycle automatically so long as the actuator 130 is maintained in its upper position.

A working tool conforming to the above described embodiment has been tested and found to be more than 80% efficient. That is, the actual measured energy of the piston is more than 80% of the theoretical energy obtainable. The total cross sectional area of the vent passages of the actual tool was equal to approximately 28% of the cross sectional area of the working cylinder.

This embodiment, as will be apparent from the detailed description, is extremely simple. The four necessary functions of opening and closing a main valve, opening and closing a vent for the lower portion of the working cylinder, opening and closing an exhaust passage for the upper end of the cylinder, and opening and closing the return reservoir are all accomplished by a single moving component.

Furthermore, the timing of these actions can be controlled with precision. Specifically, by proper location of sealing O rings, each of the four functions must necessarily take place in a predetermined sequence. A further advantage of this construction is that the vent passages at the bottom of the cylinder are normally closed. This is of particular importance in commercial applications wherein a normally opened vent passage would permit the accumulation of foreign matter in the working cylinder.

The specific remote valve described earlier has one major advantage. That is, this valve is "teaseproof." With the conventional remote valve as known in the art, the operator may "tease" the trigger, causing in effect a slow bleeding off of the air holding the main valve closed. This of course greatly effects the speed of cycling of the tool. In the remote valve described earlier, the opening and closing of the main valve is controlled by movement of the oscillating stem. Even though the operator may "tease" the trigger, the oscillating stem will shift at full speed from one position to the other, thereby insuring maximum cycling speed for the tool.

Another Embodiment of the Invention

Figure 8:
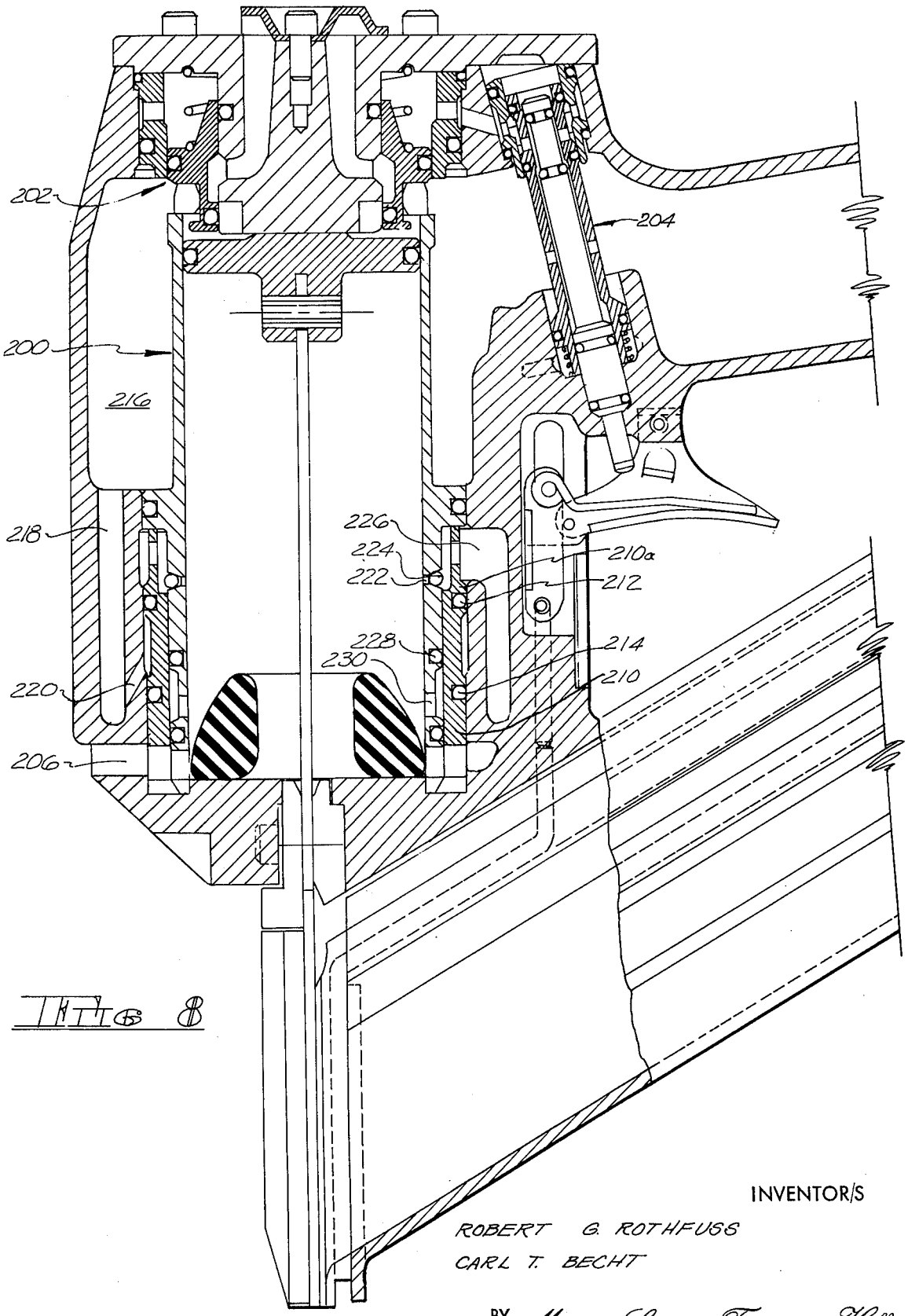
FIG. 8 is a cross sectional view showing a modification of the tool of this invention.

A second embodiment of the invention is shown in FIG. 8, and will be very briefly described below.

This embodiment contemplates a fixed cylinder 200 within which the piston driver assembly is reciprocated. Control of compressed air into the working cylinder, and exhaust of the upper portion of the working cylinder to atmosphere is controlled by the springless firing valve indicated generally at 202. The details of construction and operation of the springless firing valve are set forth in U.S. Pat. No. 3,170,487 in the name of A. G. Juilfs et al, issued on Feb. 23, 1967.

The remote valve indicated generally at 204 is similar in operation and principle to the remote oscillating valve 214 shown and described in U.S. Pat. No. 3,278,104 in the name of C. T. Becht et al, issued on Oct. 11, 1966.

For present purposes, it will be understood that air under pressure is normally supplied to the uppermost surface of the springless firing valve through the remote valve 204. Upon movement of the manually actuatable element of the remote valve, further communication between the remote valve and the reservoir is cut off, and the air above the springless firing valve is vented to atmosphere. This permits the main valve to be opened, admitting compressed air into the working cylinder to drive the piston in a working stroke. The springless firing valve is closed by readmitting air under pressure to its top surface.

The vent passages for the lower portion of the working cylinder are indicated in this embodiment at 206.

The vent valve comprises a tubular structure 210 which is slidable about the exterior of the lower portion of the cylinder sleeve 200. The vent valve sleeve includes an annular land 210*a* of enlarged diameter, and carries on its exterior the O rings 212 and 214. It is normally maintained in the up position as shown in FIG. 8 by air under pressure which passes from the main tool reservoir 216 through the passages 218 and 220 to the underside of the enlarged land 210*a*. Thus, during the working stroke of the piston, the vent valve sleeve 210 will be in a position such that the vent passages 206 are open to atmosphere.

When the working piston reaches its lowermost position, air under pressure in the main cylinder may pass through the ports 222, past the O ring 224, and into the return reservoir 226. This air under pressure is therefore acting downwardly on the entire annular area of the exhaust valve sleeve 210, and forces it downwardly to a position wherein the vent passage 206 is sealed. This action also moves the interior wall of the sleeve 210 out of sealing engagement with the O ring 228, thereby permitting air under pressure in the return reservoir to act on the underside of the piston via the ports 230 in the cylinder wall.

When the upper portion of the working cylinder is vented by the closing of the firing valve 202, the air under pressure acting on the underside of the piston is effective to return it to the normal, upper position. When the piston returns, the lower end of the cylinder is open to atmosphere through the nose piece of the tool, and all pressure in the return reservoir is exhausted to atmosphere. Thus, the air acting through the passage 220 once again returns the vent valve sleeve 210 to the uppermost position as shown.

It is believed that the foregoing constitutes a full and complete disclosure of this invention, and no limitations are intended except insofar as set forth in the claims which follow.

The embodiments of the invention in which an exclusive property or privilege is claimed are defined as follows:

1. In a fastener applying device including a tool body adapted to be connected to a supply of air under pressure, a cylinder in said tool body, a piston and fastener driver reciprocable in said cylinder in opposed working and return strokes from a full up position to a full down position and back, a return air reservoir in said body, a first port communicating between said cylinder and said reservoir just above the full down position of said piston, a resilient bottom stop free of engagement with said cylinder, and means in said tool body fixing said stop to said tool body, the improved structure comprising:

a. a first vent passage providing communication between the lower portion of said cylinder and atmosphere, b. a second vent passage providing communication between the upper portion of said cylinder and atmosphere, c. a second port communicating between said return air reservoir and said cylinder adjacent the lower end thereof, d. said cylinder incorporating an external annular valve element, and being reciprocable in said tool body, e. said tool body presenting an internal annular valve seat cooperating with said annular valve element to constitute a main valve for controlling air into said cylinder, f. said tool body at its lower end having an annular sealing element below said first vent passage, g. the lower end of said cylinder engaging said sealing element when said cylinder is in main valve closing position, h. the upper end of said cylinder having a portion to close said second vent passage when said cylinder is in main valve opening position, i. said cylinder having also a portion to close said second port when said cylinder is in main valve opening position;

whereby, when said cylinder is moved to main valve opening position, concurrently said first vent passage is opened, said second vent passage is closed, and said second port is closed; and when said cylinder is moved to main valve closing position, concurrently said first vent passage is closed, said second vent passage is opened, and said second port is opened.

2. The improved structure claimed in claim 1 wherein said first vent passage has a cross sectional area approximately 14% of the cross sectional area of said cylinder, whereby said piston, upon reaching maximum velocity, does not decelerate during the balance of its stroke.

3. The improved structure claimed in claim 1 including means for utilizing said air under pressure to move said axially movable sleeve.

4. In a fastener applying device including a tool body adapted to be connected to a supply of air under pressure, a cylinder in said tool body reciprocable between limits, a piston reciprocable in said cylinder in opposed working and return strokes from a full up position to a full down position and back, said piston having a driver secured thereto, a resilient bottom stop for said piston free of engagement with said cylinder and fixed to said tool body, and a return air reservoir in said tool body, a first port communicating between said cylinder and said reservoir just above the full down position of said piston;

a. a first vent passage providing communication between said lower portion of said cylinder and atmosphere, b. a second vent passage providing communication between the upper portion of said cylinder and atmosphere, c. a second port communicating between said return air reservoir and said cylinder adjacent the lower end thereof, d. said reciprocable cylinder having an element constituting a main valve for controlling air flow into said cylinder, and said tool body having an element constituting a seal therefor, said main valve being open at one limit of reciprocation of said cylinder and closed at the other limit of reciprocation of said cylinder, e. said cylinder at the main valve open limit of its movement, opening concurrently said first vent passage, closing said second vent passage, and closing said second port; and f. said cylinder at the main valve close limit of its movement, closing concurrently said first vent passage, opening said second vent passage, and opening said second port.

5. The structure of claim 4, wherein said tool body has an annular sealing element below said first vent passage, and the lower end of said cylinder seals against said sealing element when said cylinder is at the main valve close limit of its movement.

6. The structure of claim 4, wherein said first vent passage has a cross sectional area approximately 14% of the cross sectional area of said cylinder, whereby said piston, upon reaching maximum velocity, does not decelerate during the balance of its stroke.

7. The structure of claim 4 including means for utilizing said air under pressure to reciprocate said cylinder in said tool body.

* * * * *